US006474345B2

(12) United States Patent
Rodriquez et al.

(10) Patent No.: US 6,474,345 B2
(45) Date of Patent: Nov. 5, 2002

(54) COSMETIC CONTAINER WITH CAP

(75) Inventors: Jack Rodriquez, Verona, NJ (US); Charles Chang, 55 Westview Ave., Wayne, NJ (US) 07470

(73) Assignee: Charles Chang, Wayne, NJ (US)

( * ) Notice: Subject to any disclaimer, the term of this patent is extended or adjusted under 35 U.S.C. 154(b) by 0 days.

(21) Appl. No.: 09/681,688

(22) Filed: Jun. 27, 2001

(65) Prior Publication Data

US 2002/0051671 A1 May 2, 2002

Related U.S. Application Data

(63) Continuation-in-part of application No. 09/617,924, filed on Jul. 17, 2000.

(51) Int. Cl.[7] ..... A45D 40/18
(52) U.S. Cl. ..... 132/286
(58) Field of Search ..... 132/286, 294, 132/295, 297, 317, 318, 333; 401/52, 88, 98, 195; D19/36, 54, 58

(56) References Cited

U.S. PATENT DOCUMENTS 193,187 A * 7/1877 Scott ..... 401/52
377,974 A * 2/1888 Wheless ..... 401/52
1,655,365 A * 1/1928 Gurtov ..... D19/54
3,639,069 A * 2/1972 Gordon ..... 401/195
5,005,697 A * 4/1991 Jimbo et al. ..... 132/294
5,301,808 A * 4/1994 Pierson ..... 132/297
5,909,740 A * 6/1999 Sussman ..... 132/318
5,970,989 A * 10/1999 Litton ..... 132/218

* cited by examiner

*Primary Examiner*—Eduardo C. Robert
(74) *Attorney, Agent, or Firm*—Richard A Joel, Esq.

(57) ABSTRACT

A cosmetic container for mounting on a pencil comprises a hollow cylindrical body portion having an aperture at one end and a curved outwardly extending portion at the other end having a pivotal cap attached thereto. The outwardly extending portion comprises a recess for holding cosmetics and a notch to facilitate opening the cap which is attached by a living hinge. The outwardly extending portion includes a recessed cylindrical portion which extends upwardly to engage the hollow cap in a snap fit. The hollow cylindrical body portion engages a pencil end fitting over the eraser to permit easy access to cosmetic, such as lip-gloss.

4 Claims, 1 Drawing Sheet

COSMETIC CONTAINER WITH CAP

CROSS REFERENCE TO RELATED APPLICATIONS

This application is a Continuation-in-Part of Ser. No. 09/617,924 filed Jul. 17, 2000.

BACKGROUND OF INVENTION

1. Field of the Invention

This invention relates to cosmetic containers and particularly to an inexpensive small container, which may be inconspicuously mounted on a pencil and is readily available for use, particularly by teenage girls.

2. Description of Related Art Including Information Disclosed under 37 CFR Sections 1.97—1.97

The prior art includes patent many cosmetic containers such as U.S. Pat. No. 5,257,696 to GREEN, which discloses a mirrored lipstick container.

U.S. Pat. No. 5,178,478, discloses a lipstick case combining a holder, a lip brush, and a clip for holding a mirror and the top of a conventional lipstick. A universal dispenser cover is shown in U.S. Pat. No. 5,715,961

The prior art also includes patents having to do with pencils such as U.S. Pat. No. 5,647,138 to TANG, et al, on a cap sharpener for clutch-type pencils.

U.S. Pat. No. 4,269,523 to KAYE, discloses a pencil kit including a pencil, a coloring rod, a sheath and a cap to fit over one end which includes pencil sharpening and retaining means. Design patent D339,235, discloses a cosmetic container cap, sponge, brush and comb.

Also of interest is U.S. Pat. No. 3,639,069 to GORDON which discloses a combined pen or pencil compartment with a differently shaped container with no lip and a lift-off top and U.S. Pat. No. 5,005,697 to JIMBO on a make-up case with a hinge.

The prior art does not disclose applicants" unique combination which permits individuals such as teenage girls to conveniently carry and inconspicuously use cosmetics such as lip gloss, etc.

SUMMARY OF INVENTION

This invention relates to cosmetic containers and more particularly to a container, which is mounted on a pencil for ease of use and convenience. The preferably plastic container includes an elongated hollow cylindrical portion having an aperture at its lower end to engage a pencil top. The upper portion comprises a container having a pivotable cap mounted over the top of the container portion.

The container portion curves outwardly from the cylindrical portion in an upward direction forming a hollow chamber for cosmetics. The curved portion terminates in a lip, which extends substantially thereabout terminating in a vertical ring, which provides a force fit with the cap sides. The cap includes an upper reflective surface with a downwardly extending wall to engage the ring. The cap is affixed to the lip by an integral plastic hinge which a section of the curved portion adjacent the lip is recessed to facilitate opening the cap by inserting a finger or finger nail into the recess to force the cap open.

A cosmetic, such as a lip balm, may be located in the container so that an individual such as a student or worker can conveniently open the cap and apply the lip balm or other product in an expeditious and inconspicuous manner. It is also easy to carry the container since it is rather small and mounted on a pencil. The container is translucent to enhance viewing into the container.

Accordingly, an object of this invention is to provide a new and improved cosmetic container, which is mounted on a pencil.

Another object of this invention is to provide a new and improved pencil mounted cosmetic container, which includes an integral hinge cap.

A further object of this invention is to provide a new and improved pencil mounted plastic cosmetic container, which is small, inexpensive, convenient and inconspicuous.

A more specific object of this invention is to provide a new and improved cosmetic container which includes a lower cylindrical portion for mounting on a pencil, a top container portion having a recessed area to receive cosmetic and a cap having a flexible hinge pivotably securing the cap to the container portion.

BRIEF DESCRIPTION OF DRAWINGS

The above and other objects and advantages of this invention may be more clearly seen when viewed in conjunction with the accompanying drawings wherein.

DETAILED DESCRIPTION

Figure 1:
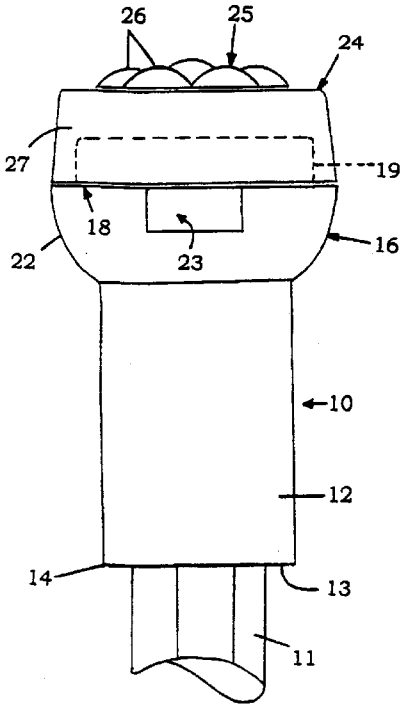
FIG. 1 is a perspective view of the cosmetic container mounted on a pencil with the cap in a closed position.
Figure 2:
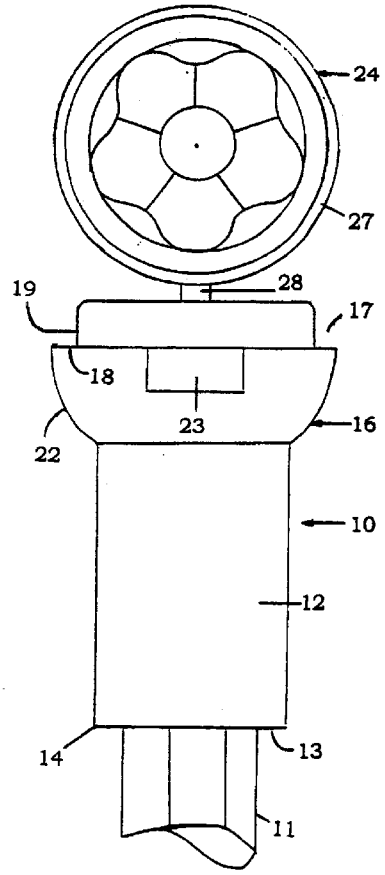
FIG. 2 is a view of the cosmetic container of FIG. 1 with the cap in an open position.
Figure 3:
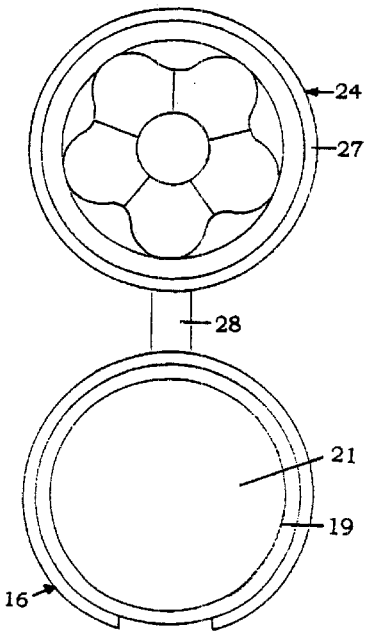
FIG. 3 is an end view of the cosmetic container showing the inside of the container and the hinged cap.

Referring now to the drawings, this invention comprises a cosmetic container 10 shown in FIG. 1, which is mounted on a pencil 11. The container 10 includes a lower cylindrical portion 12 having a recess 13 at its lower end 14. One end of the pencil 11 engages the recess 13 and is mounted within the cylinder portion 12 in a force fit.

An upper container portion 16 extends outwardly from the cylindrical portion 12 in a curved configuration terminating in a horizontal lip 17. The inner edge 18 of the lip 17 terminates in a cylindrical ring 19, which extends about the lip 17. A recess 21 is formed by the curved container wall 22 and the ring 19. A supply of cosmetic (not shown) is mounted in the recess 21.

The upper portion of the wall 22 includes a notch 23, which permits the cap 24 to be easily opened by exerting a finger pressure there against. The cap includes a top surface 25 which may include various designs such as projecting lens type bubbles 26 for attractiveness. The cap 24 also includes a downwardly extending cylindrical wall 27, which engages the ring 19 in a force fit. The cap 24 is mounted to the lip 17 by a plastic or living hinge 28.

To open the cap 24, one inserts their finger into the notch 23 and forces the cap upwardly. The cosmetic, such as lip balm may then be applied with one's finger. Having such easy access to the cosmetic, increases the possibility of use. The container 10 is preferably of an attractive plastic material which permits the fit required by the invention and is inexpensive. The cap 10 may be readily and inexpensively molded. The container 10 including the cap 24 is translucent so that various cosmetic shades are visible through the container.

While the invention has been explained by a detailed description of certain specific embodiments, it is understood that various modifications and substitutions can be made in any of them within the scope of the appended claims, which are intended also to include equivalents of such embodiments.

what is claimed is:

1. A cosmetic container comprises:

an elongated cylindrical pencil having a sharpened end for writing, an elongated body and an upper end;

a container having a cylindrical portion having an aperture at one end for fixedly engaging the upper pencil end in a non-movable arrangement and extending a predetermined distance along the elongated pencil body and another end opposite to the one end, at which the upper pencil end terminates;

a container portion having another curved portion extending convexly from the end of the cylindrical portion for a predetermined distance, a lip having an inner and outer end and a surface extending inwardly to the inner end, said curved portion terminating in the outer end of the inwardly extending lip, an upwardly extending ring portion at the inner end of said lip, a recess defined by said curved portion and said ring for storing cosmetics;

a living hinge having a first end and a second end and a body therebetween integrally mounted to said lip at the second end; and, a cap mounted to the first end of the hinge, said cap having a top and a downwardly extending wall to frictionally engage the ring portion sealing the container.

2. A cosmetic container in accordance with claim 1 wherein:

the curved portion includes a notch in the curved portion adjacent the lip to facilitate opening the cap.

3. A cosmetic container in accordance with claim 2 wherein:

the container is translucent, to enhance viewing into the container; and the container comprises a translucent plastic material and wherein the cylindrical portion is secured to the pencil in a force fit and the cap is secured to the ring in a force fit.

4. A cosmetic container in accordance with claim 2 wherein:

the cap top includes a plurality of bubble type projections and the cap top is translucent.

* * * * *